US007412784B1

(12) United States Patent
Bobbett

(10) Patent No.: US 7,412,784 B1
(45) Date of Patent: Aug. 19, 2008

(54) SHOE TRACTION SYSTEM

(75) Inventor: Jonathan Bobbett, Rye, NH (US)

(73) Assignee: Callaway Golf Company, Carlsbad, CA (US)

( * ) Notice: Subject to any disclaimer, the term of this patent is extended or adjusted under 35 U.S.C. 154(b) by 354 days.

(21) Appl. No.: 11/370,247

(22) Filed: Mar. 6, 2006

Related U.S. Application Data

(60) Provisional application No. 60/696,041, filed on Jul. 1, 2005.

(51) Int. Cl.
*A43C 15/00* (2006.01)

(52) U.S. Cl. ..... 36/67 R; 36/61; 36/134; 36/59 R

(58) Field of Classification Search ..... 36/67 R, 36/67 D, 134, 61, 59 R
See application file for complete search history.

(56) References Cited

U.S. PATENT DOCUMENTS 3,631,614 A * 1/1972 Rice ..... 36/61
4,240,215 A * 12/1980 Broussard ..... 36/67 D
4,470,207 A * 9/1984 Bente ..... 36/134
4,523,396 A * 6/1985 Dassler ..... 36/134
5,377,431 A * 1/1995 Walker et al. ..... 36/134
5,505,012 A * 4/1996 Walker et al. ..... 36/134
5,743,029 A * 4/1998 Walker et al. ..... 36/134
6,481,122 B2 * 11/2002 Brahler ..... 36/134
7,194,826 B2 * 3/2007 Ungari ..... 36/134
2005/0172518 A1 * 8/2005 Ungari ..... 36/134
2007/0251128 A1 * 11/2007 Yen ..... 36/134

* cited by examiner

*Primary Examiner*—Marie Patterson
(74) *Attorney, Agent, or Firm*—Elaine H. Lo; Michael A. Catania

(57) ABSTRACT

A shoe traction system may have an attachment element to allow the orientation of a traction device, such as a golf spike or cleat, to change relative to a sole. The system may further include a positioning element made from a resilient material and returns the spike to a neutral position. The density of the resilient material may be selected according to a weight of a user of the shoe traction system. In operation, the shoe traction system may allow each spike secured to the outsole to form a dynamic positioning system for uneven or varying ground surfaces. The spikes may work independently of each other and all spikes may be adjusting at all times to any change in surfaces.

15 Claims, 3 Drawing Sheets

SHOE TRACTION SYSTEM

REFERENCE TO RELATED APPLICATIONS

This application claims priority from U.S. Provisional Application No. 60/696,041 filed on Jul. 1, 2005.

BACKGROUND

Athletic shoes, such as golf shoes, typically comprise an outsole having spikes or cleats secured to the outsole. The outsole is the element of the shoe that contacts the ground. The spikes or cleats extend from the outsole and contact the ground to improve traction of the shoe. The spikes or cleats may be formed of one-piece construction with the outsole. Alternatively, the spikes may be removable and secured to the outsole. In either case, the orientation of the spike or cleat is fixed with respect to the outsole when the shoe is in use.

Walking on shoes with spikes becomes difficult when surface types and levels change. For example, a user may be walking on level ground of cement, gravel, dirt, or grass. The user may then walk on a hillside or a slope, or the ground may become uneven. Thus, it is desirable to have a shoe traction system that can provide proper traction and grip on different types of surfaces and changing surface levels.

BRIEF DESCRIPTION OF THE DRAWINGS

The above and other features and advantages of embodiments of the invention will become readily apparent by reference to the following detailed description when considered in conjunction with the accompanying drawings.

DETAILED DESCRIPTION

As will be apparent to those skilled in the art from the following disclosure, the invention as described herein may be embodied in many different forms and should not be construed as limited to the specific embodiments set forth herein. Rather, these embodiments are provided so that this disclosure will fully convey the principles and scope of the invention to those skilled in the art.

Some of the inventive principles of this patent disclosure relate to a shoe traction system having an attachment element to allow the orientation of a traction device to change relative to a sole. For example, a golf shoe may have an attachment element with a receptacle for a spike or cleat. The spike or cleat may also be integral to the attachment element.

The system may include a positioning element which may be made from a resilient material and returns the spike or cleat to a neutral position. The density of the resilient material may be selected according to a weight of a user of the shoe traction system.

In another embodiment, the inventive principles of this disclosure relate to an athletic shoe having an upper and a sole including one or more resilient sockets to receive one or more traction devices.

In yet another embodiment, the inventive principles of this disclosure relate to a method including attaching a traction device to an athletic shoe and rocking the traction device responsive to the surface on which the shoe is used. The method includes returning the traction device to a neutral position when the traction device is not in contact with the surface. The method also includes attaching a second traction device to the shoe and rocking the second traction device independently of the first traction device responsive to the surface.

In still yet another embodiment, the inventive principles of this patent disclosure relate to a shoe traction system having an attachment means for allowing the orientation of a traction device to change relative to a sole. The system may also include a positioning means for dynamically adjusting the orientation of the traction device.

Figure 1:
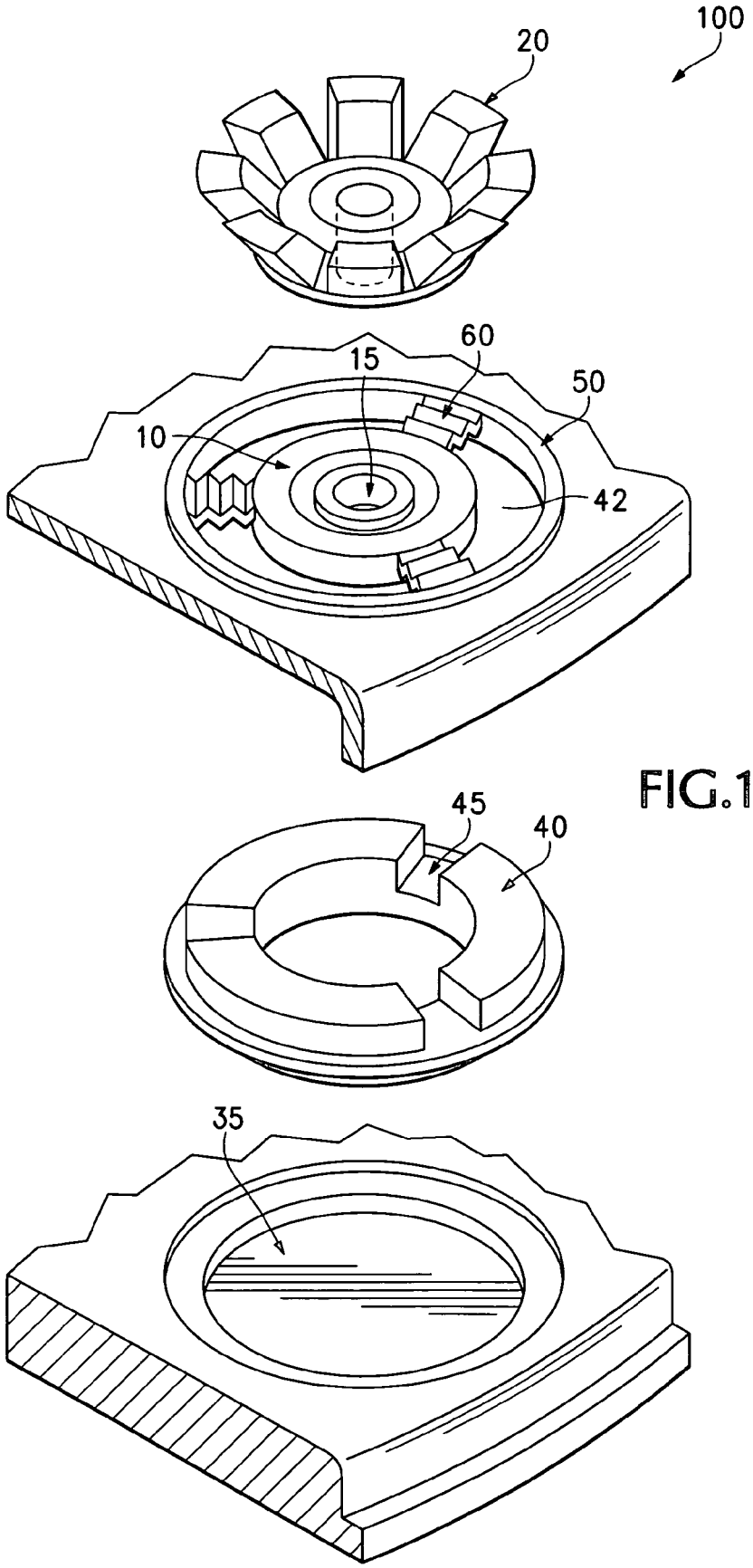
FIG. 1 illustrates an exemplary embodiment of a shoe traction system.

Referring now to FIG. 1, one embodiment of a shoe traction system 100 preferably includes an attachment element 10 that allows the orientation of a traction device 20 to change relative to a sole 30. The traction device 20 may include a golf or other type of cleat or spike. In one embodiment, the attachment element 10 may include a receptacle 15 for inserting the traction device 20. In another embodiment, the attachment element 10 may be integral with the traction device 20.

The shoe traction system 100 also preferably includes a frame 50 to hold the attachment element 10. The frame 50 is preferably made from a variety of materials, including but not limited to, materials such as thermal plastic urethane (TPU), plastic, and natural or synthetic rubber that is designed, molded, and configured to hold the attachment element 10 and a receptacle 15 in place. In one embodiment as shown in FIG. 1, the attachment element 10 includes a disc and the frame 50 includes a ring surrounding the disc. The attachment element 10 is preferably connected to the frame 50 by one or more connecting elements 60. The connecting elements 60 are preferably designed to allow the position of the attachment element 10 to change responsive to a surface. In one embodiment as shown in FIG. 1, the connecting elements 60 may be formed of corrugated elements.

The shoe traction system 100 further preferably includes a positioning element 40 to dynamically adjust the orientation of the traction device 20 relative to the sole 30. The positioning element 40 may be made of a resilient material such as EVA, polyurethane, thermal plastic rubber or other foam-type materials designed and configured to fit into the sole 30. As shown in FIG. 1, the positioning element 40 is preferably designed to fit in the space 42 between the attachment element 10 and frame 50. The positioning element 40 may also include one or more grooves 45 to receive the one or more connecting elements 60.

The sole 30 is reverse molded and configured to hold the positioning element 40. In one embodiment, the shoe traction system 100 preferably includes a depression 35 in the sole 30 to receive the positioning element 40. The sole 30 is preferably made with a material such as ethylene vinyl acetate (EVA) or polyurethane foam that provides a cushioned base or foundation element for the golf or sport shoe.

Figure 2:
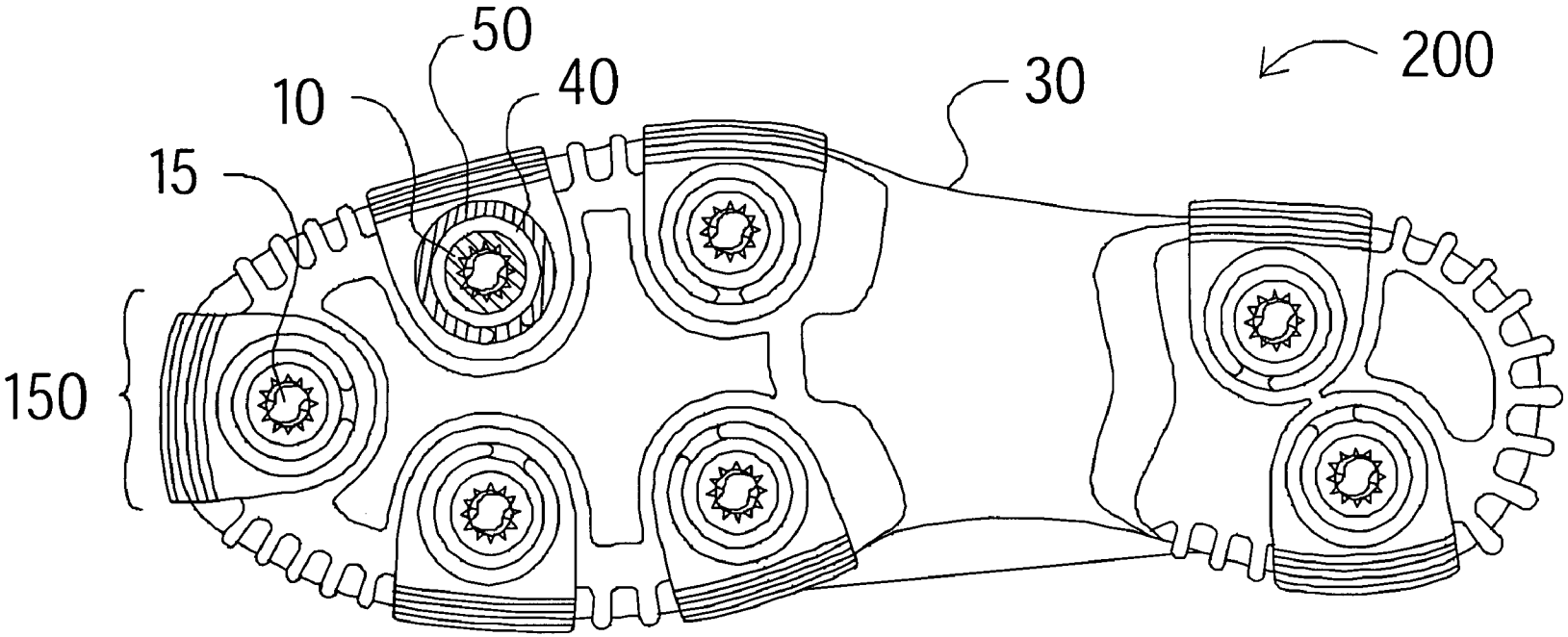
FIG. 2 is a view of an outsole with a shoe traction system according to principles of the invention.

In FIG. 2, the components shown in FIG. 1 are assembled as a complete outsole 200. The outsole 200 may be secured to an upper (not shown) to form an athletic shoe. The outsole 200 comprises a number of sockets 150 surrounding a golf or other spike receptacle 15 prior to the insertion of the golf or other spike and/or cleats 20 (FIG. 1) into the receptacle 15. As previously described, the outsole 200 may also be formed with the golf or other spike and/or cleat 20 integral with the attachment element 10.

Each socket 150 in the outsole 200 includes a positioning element 40, an attachment element 10, and the frame 50 to secure the attachment element 10 and the positioning element 40 to the sole 30. It is to be appreciated that although the illustrated embodiment shows two sockets 150 in the heel region and five in the forefoot region, any number of sockets 150 may be used at any position along the sole 30.

In operation, the shoe traction system 100 allows each golf spike or cleat 20 secured to the outsole 200 to form a dynamic positioning system for uneven or varying ground surfaces. The spikes or cleats 20 work independently of each other and all spikes 20 are adjusting at all times to any change in surfaces to provide traction and stability on varying surfaces. That is, the shoe traction system 100 provides each spike 20 the ability to "rock" responsive to changes in the surface.

Figure 3:
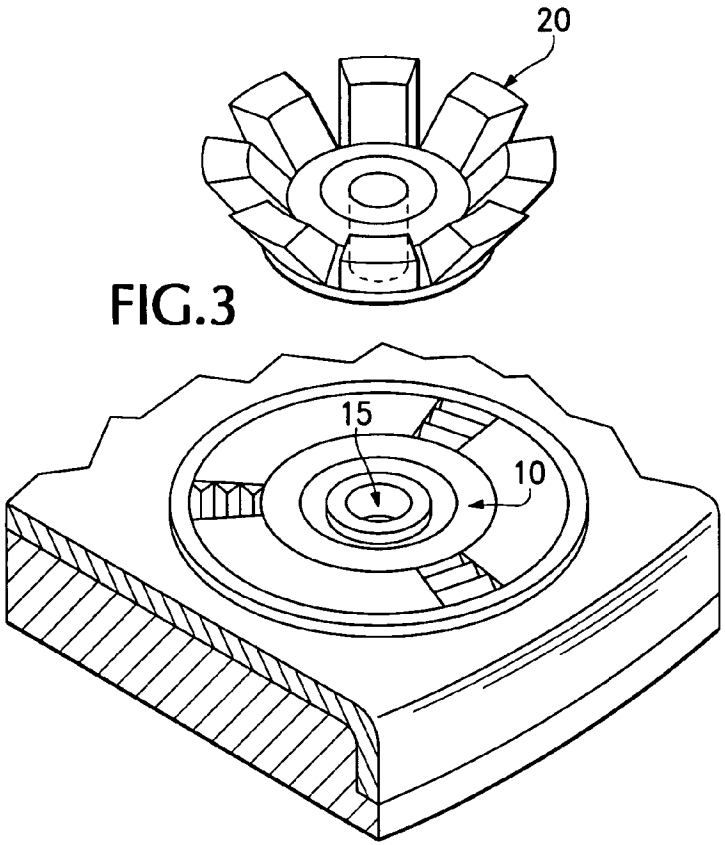
FIG. 3 is a view of an attachment element and frame in a shoe traction system.

Referring to FIG. 3, an attachment element 10 is shown with a receptacle 15 for inserting a traction device 20. It should be appreciated that the receptacle 15 may be configured to receive traction devices having different types of mechanisms for fastening the traction device to an outsole, including traction devices having threads or other commercially available traction devices such as Black Widow® cleats using Q-Fit™ and Fast Twist® cleat installation systems.

Figure 4:
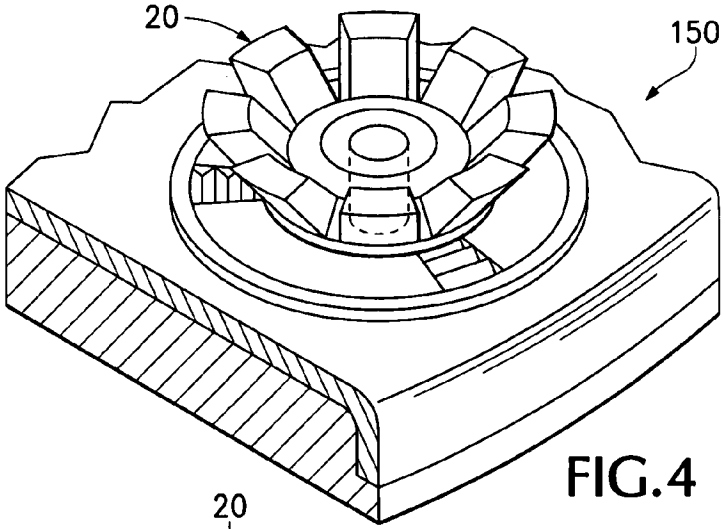
FIG. 4 illustrates the orientation on a level surface of a traction device inserted into a shoe traction system according to principles of the invention.

Referring to FIG. 4, a socket 150 of FIG. 2 is shown. As illustrated, the golf spike or cleat 20 is shown in a static state or a position where the surface is even. For example, a user may be walking or standing on level ground. The positioning element 40 flexes inward slightly but allows the golf spike or other cleat 20 to maintain its normal or naturally designed position vis-à-vis the ground or surface. The positioning element 40 is further structured to return the traction device 20 to a neutral position when the traction device is not in contact with the surface.

Figure 5:
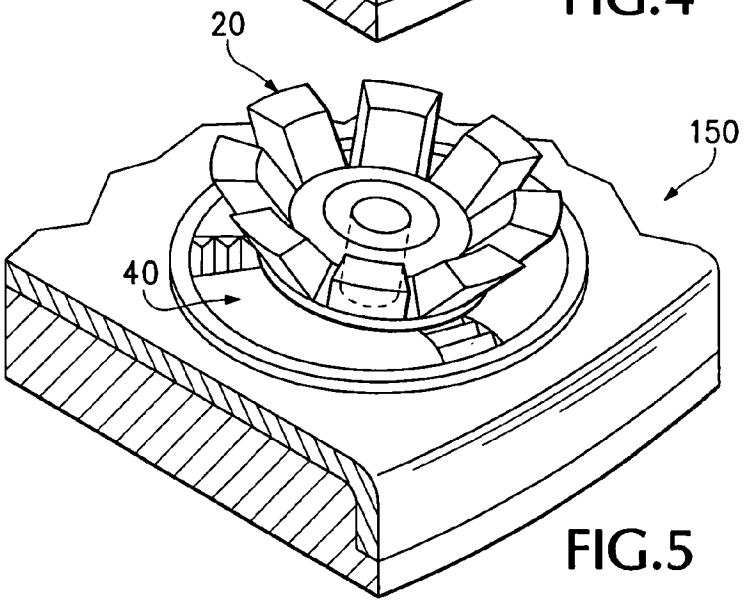
FIG. 5 illustrates the orientation on an uneven surface of a traction device inserted into a shoe traction system according to principles of the invention.

Referring now to FIG. 5, a socket 150 having a traction device 20 on an uneven surface is shown. The socket 150 works as a constant leveling system that allows for the golf spike or cleat 20 to articulate in reference to a changing surface and to achieve a position close to or level with the surface. If the user is standing or walking on a surface, such as a hillside, slope, or uneven ground that places the user's foot in a non-level position with respect to the surface, the positioning element 40 preferably flexes and compresses in the upward direction of the slope or uneven surface and allows the golf spike or other cleat 20 to maintain an increased level position of the spike 20 vis-à-vis the uneven surface. Thus, the socket 150 allows the golf or other spike 20 to maintain as much surface area as possible with the ground or surface.

Referring back to FIG. 2, in another embodiment, the positioning element 40 in each socket 150 may be produced in varying density or hardness. The varying density or hardness allows for a modification of each positioning element 40 so that some sockets 150 of the outsole 200 could be made harder while other sockets 150 in different parts of the outsole 200 could be softer. Further, the sockets 150 can be modified for a shoe user who is smaller (or has smaller size shoes) and is lighter in weight. Lighter shoe users can have softer density sockets 150 while other shoe users who are heavier and have larger sized feet can have sockets 150 with harder densities. The ability to vary and/or adjust the hardness or density of the sockets 150 produces a tuning or tuned effect on the overall shoe.

The density of the positioning element 40 can be produced in densities corresponding, for example, to average shoe size ranges and, thus, corresponding to average weight ranges. For example, shoe sizes in the range of sizes 6 to 8 can use positioning elements 40 having a first lowest density or hardness. Shoe sizes in the range of sizes 8.5 to 11 can have positioning elements 40 having a second higher density or hardness. Shoe sizes in the range of sizes 11.5 to 14 (or higher) can have positioning elements 40 having a third and highest density or hardness. Thus, the shoe could be tuned to the size and weight of the user.

It should be appreciated that reference throughout this specification to "one embodiment" or "an embodiment" means that a particular feature, structure, or characteristic described in connection with the embodiment may be included in at least one embodiment of the invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined or separated as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, having described exemplary embodiments of the invention, it is noted that modifications and variations can be made by persons skilled in the art in light of the above teachings. Therefore, it is to be understood that changes may be made to embodiments of the invention disclosed that are nevertheless still within the scope and the spirit of the claims.

What is claimed is:

1. A shoe traction system comprising:

a frame; and an attachment element connected to the frame by at least one connecting element, the attachment element allowing the orientation of a traction device to change relative to a sole, wherein the at least one connecting element is corrugated.

2. The system of claim 1 further including a positioning element to dynamically adjust the orientation of the traction device relative to the sole.

3. The system of claim 2 wherein the positioning element is structured to return the traction device to a neutral position.

4. The system of claim 3 wherein the positioning element includes a resilient material.

5. The system of claim 2 further including a depression in the sole to receive the positioning element.

6. The system of claim 3 wherein the positioning element includes a material selected from the group consisting of ethylene vinyl acetate (EVA), polyurethane, thermal plastic rubber, and foam.

7. The system of claim 1 wherein the attachment element includes a receptacle for the traction device.

8. The system of claim 1 wherein the attachment element is integral with the traction device.

9. The system of claim 1 wherein:

the attachment element comprises a disc; and the frame comprises a ring surrounding the disc.

10. The system of claim 2 wherein the positioning element includes at least one groove to receive the at least one connecting element.

11. An athletic shoe comprising:

an upper;

a sole secured to the upper and having a plurality of resilient sockets formed therein; and a plurality of traction devices, each traction device located in a corresponding resilient socket of the sole, wherein associated with each socket of the sole are a positioning element, an attachment element, and a frame, the attachment element and the positioning element allowing the orientation of the corresponding traction device to change relative to the sole, the attachment element being connected to the frame by at least one corrugated connecting element.

12. The athletic shoe of claim 11 wherein the positioning element is structured to return the traction device to a neutral position.

13. The athletic shoe of claim 11 wherein the positioning element includes a material selected from the group consisting of ethylene vinyl acetate (EVA), polyurethane, thermal plastic rubber, and foam.

14. The athletic shoe of claim 11 wherein the attachment element comprises a disc, and the frame comprises a ring surrounding the disc.

15. The athletic shoe of claim 11 wherein the positioning element includes at least one groove to receive the at least one corrugated connecting element.

* * * * *